US007887302B2

(12) United States Patent
Hutto, Jr.

(10) Patent No.: US 7,887,302 B2
(45) Date of Patent: Feb. 15, 2011

(54) HIGH PRESSURE VARIABLE DISPLACEMENT PISTON PUMP

(75) Inventor: Walter Decania Hutto, Jr., Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 9 days.

(21) Appl. No.: 12/415,401

(22) Filed: Mar. 31, 2009

(65) Prior Publication Data

US 2010/0247338 A1 Sep. 30, 2010

(51) Int. Cl.
*F04B 27/06* (2006.01)
*F04B 43/12* (2006.01)
*F15B 15/14* (2006.01)
*F01B 15/02* (2006.01)

(52) U.S. Cl. ..... 417/213; 417/270; 417/466; 417/469; 417/53; 92/12.2; 92/117 A; 91/217

(58) Field of Classification Search ..... 417/212, 417/213, 270, 466, 469; 92/12.2, 71, 177 A; 91/216 R, 217
See application file for complete search history.

(56) References Cited

U.S. PATENT DOCUMENTS 2,393,544 A * 1/1946 Lum ..... 417/269
2,990,781 A * 7/1961 Tuck et al. ..... 417/270
3,016,018 A * 1/1962 Williams ..... 417/304
3,160,102 A * 12/1964 Budzich ..... 417/282
4,576,554 A * 3/1986 Wagenseil et al. ..... 417/270
5,097,744 A 3/1992 Condrac
5,168,704 A 12/1992 Kast et al.
5,316,450 A 5/1994 Kast
5,379,585 A 1/1995 Snow et al.
5,553,452 A 9/1996 Snow et al.
6,179,574 B1 * 1/2001 Yie ..... 417/269

* cited by examiner

*Primary Examiner*—Charles G Freay
(74) *Attorney, Agent, or Firm*—Trego, Hines & Ladenheim, PLLC

(57) ABSTRACT

A variable flow pump includes: a housing with inlet and outlet chambers interconnected by a main bore and a non-rotating cylinder block positioned in the main bore. The cylinder block includes: a central bore communicating with the inlet chamber; cylinder bores arrayed around the central bore; first feed passages interconnecting the inlet chamber and the cylinder bores, defining a bypass flowpath between the cylinder bores; and at least one discharge valve disposed at the second end which permits fluid flow from the cylinder bores to the discharge chamber but prevents opposite flow; Pistons are disposed in the bores. A shaft is coupled to the pistons so as to cause them to reciprocate through an axial pump stroke when the shaft is rotated. A mechanism is coupled to the cylinder block which modulates the axial position of the cylinder block within the housing, varying the size of the bypass flowpath.

16 Claims, 4 Drawing Sheets

HIGH PRESSURE VARIABLE DISPLACEMENT PISTON PUMP

BACKGROUND OF THE INVENTION

This invention relates generally to pumps and more particularly to variable flow rate pumps for hydraulic systems.

Aircraft gas turbine engines often incorporate various high pressure hydraulic actuators to operate components such as variable geometry exhaust nozzles, vectoring exhaust nozzles, bypass doors, variable stator vanes, and the like.

Depending on which actuators are being used, the flow requirements vary greatly, and it is desirable to match pumping capacity to the demand. Variable displacement high-pressure piston pumps are therefore commonly used in engine and aircraft hydraulic systems. However, prior art variable displacement piston pumps can be complex, heavy, costly and can lack desired reliability.

BRIEF SUMMARY OF THE INVENTION

These and other shortcomings of the prior art are addressed by the present invention, which provides a high pressure, variable flow rate pump with low weight and high reliability.

According to one aspect of the invention, a variable flow pump includes: (a) a housing including an inlet chamber and an outlet chamber interconnected by a main bore; (b) a non-rotating cylinder block with first and second ends disposed in the main bore, the cylinder block including:(i) a central bore disposed in fluid communication with the inlet chamber; (ii) a plurality of cylinder bores arrayed around the central bore; (iii) a plurality of first feed passages interconnecting the inlet chamber and the cylinder bores, the first feed passages defining a bypass flowpath between the cylinder bores; and (iv) at least one check valve disposed at the second end which permits fluid flow from the cylinder bores to the discharge chamber but prevents flow in the opposite direction; (d) a plurality of pistons disposed in the bores; (e) a shaft mechanically coupled to the pistons so as to cause the pistons to reciprocate through an axial pump stroke between predetermined fill and discharge positions, when the shaft is rotated; and (f) a mechanism coupled to the cylinder block which is adapted to selectively axially position the cylinder block within the housing, so as to vary the size of the bypass flowpath.

According to another aspect of the invention, a method of operating a variable flow pump includes: (a) receiving fluid into an inlet chamber of a housing of the pump, wherein the pump includes an inlet chamber and an outlet chamber interconnected by a main bore; and (b) using a piston which reciprocates through an axial pump stroke between predetermined fill and discharge positions: (i) drawing fluid from the inlet chamber into a cylinder bore in a non-rotating cylinder block with first and second ends disposed in the main bore; (ii) discharging fluid through the cylinder bore; and (iii) during discharge, selectively bypassing a portion of the fluid from the cylinder bore through a first feed passage into the inlet chamber, the proportion of bypass being controlled by modulating the axial position of the cylinder block within the housing.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
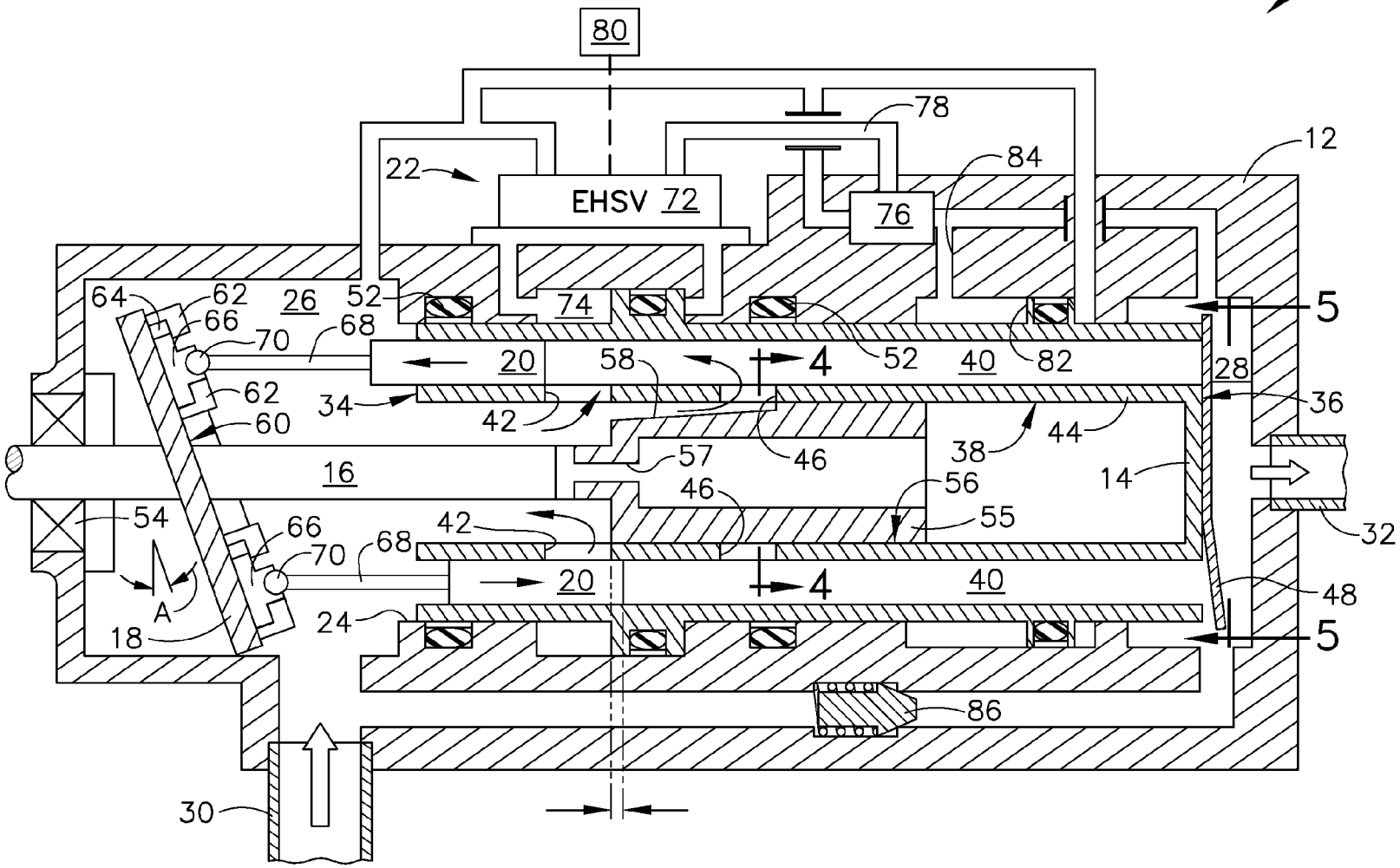
FIG. 1 is a schematic cross-sectional view of a pump constructed according to an aspect of the present invention.

Referring to the drawings wherein identical reference numerals denote the same elements throughout the various views, FIG. 1 depicts a variable displacement pump 10. The major components of the pump 10 are a housing 12, cylinder block 14, shaft 16, wobble plate 18, pistons 20, and flow modulating assembly 22.

The housing 12 includes a main bore 24. An inlet chamber 26 is disposed at one end of the main bore 24 and a discharge chamber 28 is disposed at the opposite end. An inlet 30 connects to the inlet chamber 26, and an outlet 32 connects to the discharge chamber 28.

Figure 5:
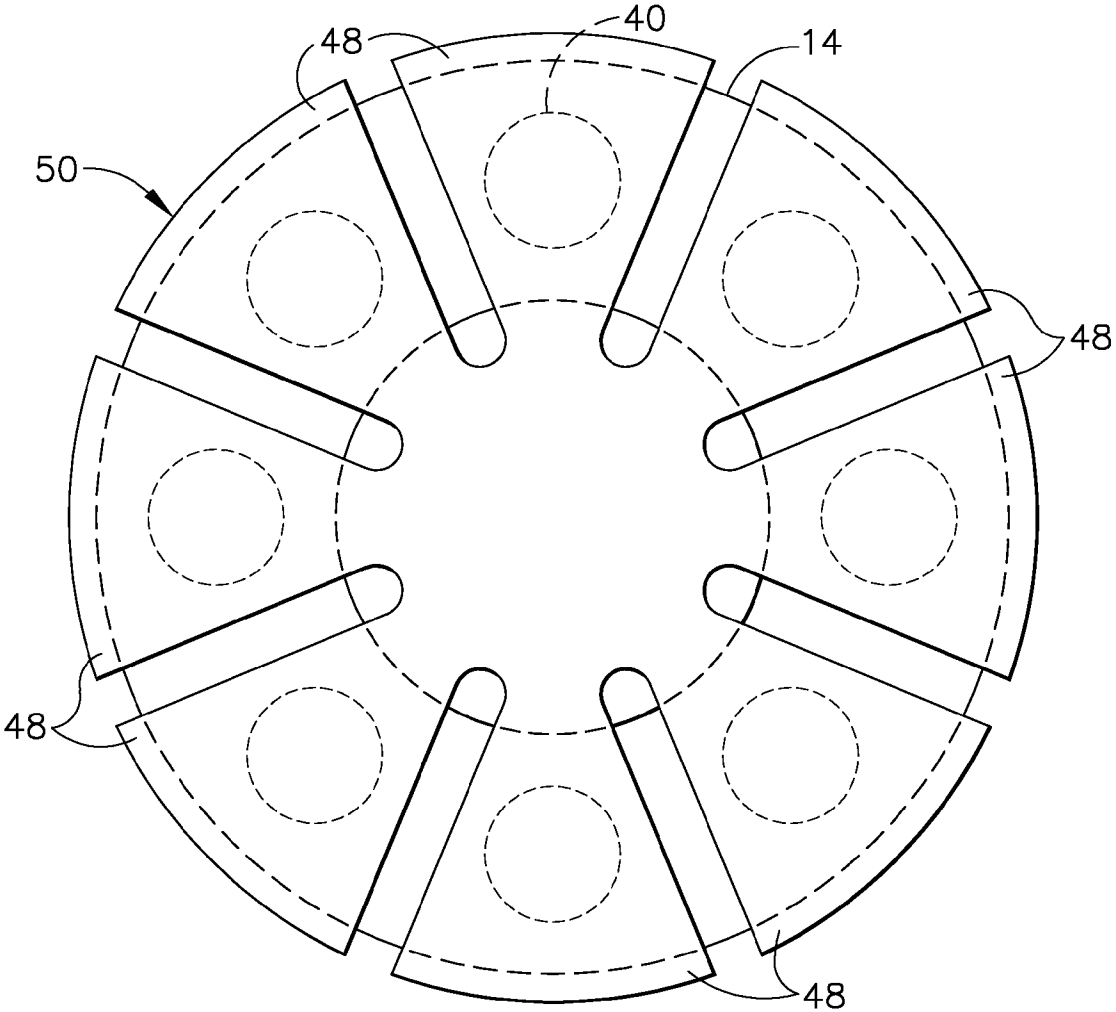
FIG. 5 is a view taken along lines 5-5 of FIG. 1.

The cylinder block 14 is received in the main bore 24. It is free to move axially, between a maximum flow position (seen in FIG. 3) and a minimum flow position (seen in FIG. 1). The cylinder block 14 is generally cylindrical and has a first end 34 and a second end 36. A central bore 38 passes down the rotational axis of the cylinder block 14. It is open at the first end to receive the shaft 16, and is closed at the second end 36. A plurality of cylinder bores 40 are arrayed around the central bore 38. A set of first feed passages 42 (i.e. slots, holes, or the like) are arrayed around the wall 44 separating the central bore 38 and the cylinder bores 40. A set of second feed passages 46 are located axially downstream of the first feed passages 42. The second end 36 of the cylinder block 14 carries discharge valves 48 which prevent backflow from the discharge chamber 28 back into the cylinder bores 40. In this particular example, as seen most clearly in FIG. 5, the discharge valves 48 are reed valves which are part of a single valve plate 50 attached to the second end 36 of the cylinder block 14. Other types of check valves could be substituted for this purpose. Leakage between the housing 12 and the cylinder block 14 is minimized by one or more seals 52. Preferably the seals 52 are a low-friction type. In the illustrated example, the seals 52 are commercially available "O"-ring energized seals with low-friction caps made from a material such as polytetrafluoroethylene (PTFE), graphite, or the like.

The shaft 16 passes through appropriate bearings and seals 54 in the housing 12. A first end of the shaft 16 extends outside the housing 12 and incorporates one or more mechanical features (not shown) such as a keyway, splines, or a driven gear, allowing the shaft to be connected to a driving element.

Figure 4:
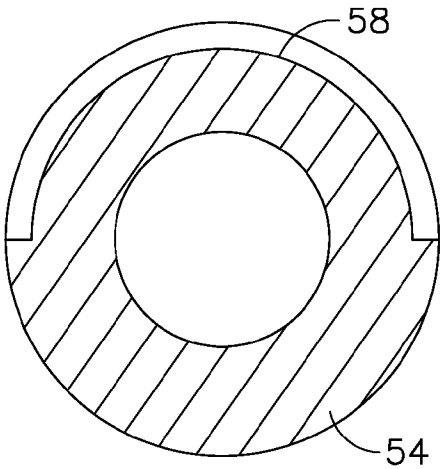
FIG. 4 is a view taken along lines 4-4 of FIG. 1.

The opposite end of the shaft 16 is formed into an enlarged plug 55 having a cylindrical outer surface 56 which fits closely in the central bore 38. A bleed port 57 is provided in the shaft 16 which lets working fluid pass freely between the inlet chamber 26 and the interior of the central bore 38. This allows the cylinder block 14 to translate axially relative to the shaft 16 without causing excessive loads or hydraulic lock. A rotating port 58 is incorporated near the second end to pass working fluid from the inlet chamber 26 to the second feed passages 46. As seen in FIG. 4, the rotating port 58 may take the form of a groove which extends halfway around the circumference of the plug 55. The rotating port 58 is positioned or "clocked" such that when a piston 20 is in the "inlet" stroke, (the upper piston 20 in FIG. 1), the rotating port 58 is open to the associated cylinder bore 40, but when a piston 20 is in the "discharge" stroke, (the lower piston 20 in FIG. 1), the corresponding cylinder bore 40 is closed off.

As seen in FIG. 1, the wobble plate 18 is mounted to the shaft 16 and is positioned in the inlet chamber 26. The wobble plate 18 is coupled to the pistons 20 in a manner that permits rotation of the shaft 16 to be converted into reciprocating axial motion of the pistons 20. In the illustrated example, the wobble plate 18 has a low-friction working face 60, which may be accomplished through polishing, application of anti-friction coatings, or the like. The working face 60 is disposed at a non-perpendicular angle "A" to the rotational axis of the shaft 16. Mounted on the working face 60 are annular flanges 62 that define an annular channel 64. A plurality of slippers 66 are received in the channel 64 and are coupled to connecting rods 68, for example through the illustrated ball joints 70. Each of the connecting rods 68 is in turn coupled to one of the generally cylindrical pistons 20. The pistons 20 can move axially but are restrained from any lateral movement by the cylinder block 14. As the wobble plate 18 is rotated by the shaft 16, the individual slippers 66 will be alternately pushed or pulled, in turn pushing or pulling the corresponding connecting rod 68 and piston 20. At any particular time in the cycle, one of the pistons 20 will be at a fully extended position (to the right in FIG. 1). The diametrically opposite piston 20 will be at a fully retracted position (to the left in FIG. 1), and the remaining pistons 20 will be at intermediate positions. The wobble plate angle A may be selected to provide the desired magnitude of axial piston stroke. The number and size of the pistons 20 as well as the shaft speed may be varied to suit a particular application as well.

Means are provided for selectively moving the cylinder block 14 to a desired axial position relative to the housing 12. Any type of actuator capable of moving the cylinder block 14 (e.g. electrical, hydraulic) may be used. In the illustrated example, the cylinder block 14 is moved by an electrohydraulic servo valve (EHSV) 72 of a known type in which a small pilot valve (not illustrated) is used to port working fluid pressure to either side of a primary cylinder (shown schematically at 74). As shown, discharge pressure may be ported to a pressure regulator 76 which in turn feeds regulated fluid pressure to the EHSV 72 through a line 78. The pressure drop across the EHSV 72 is thus nearly constant over a wide range of pump output pressures, which simplifies control programming. A controller 80 including one or more processors, such as a programmable logic controller (PLC) or computer, is coupled to the EHSV 72. The controller 80 responds to a flow demand signal and in turn drives the EHSV 72 to an appropriate position. A suitable transducer (not shown), such as a linear variable differential transformer (LVDT), may be used to provide cylinder block axial position feedback information to the controller 80.

The pump 10 operates as follows. Working fluid enters the inlet 30 and floods the inlet chamber 26 volume on the left side of the pump 10. The fluid is at a relatively low inlet pressure, which may be supplied by a suitable boost pump of a known type (not shown). Meanwhile the shaft 16 is rotating, causing the pistons 20 to reciprocate as described above. When a piston 20 is in the retracted or fill position, (the upper piston 20 in FIG. 1), the associated cylinder bore 40 is flooded with working fluid through the rotating port 58, and the first and second feed passages 42 and 46. During the discharge stroke (the lower piston 20 in FIG. 1), the rotating port 58 closes off the second feed passages 46 as described above. As the piston 20 begins its discharge stroke the pumped fluid is initially bypassed back to the inlet chamber 26 through the pressure through the first feed passages 42. When the piston 20 reaches the end of the first feed passage 42, the remaining stroke pumps fluid through the discharge valve 48 to the discharge chamber 28 and subsequently through the outlet 32.

Figure 2:
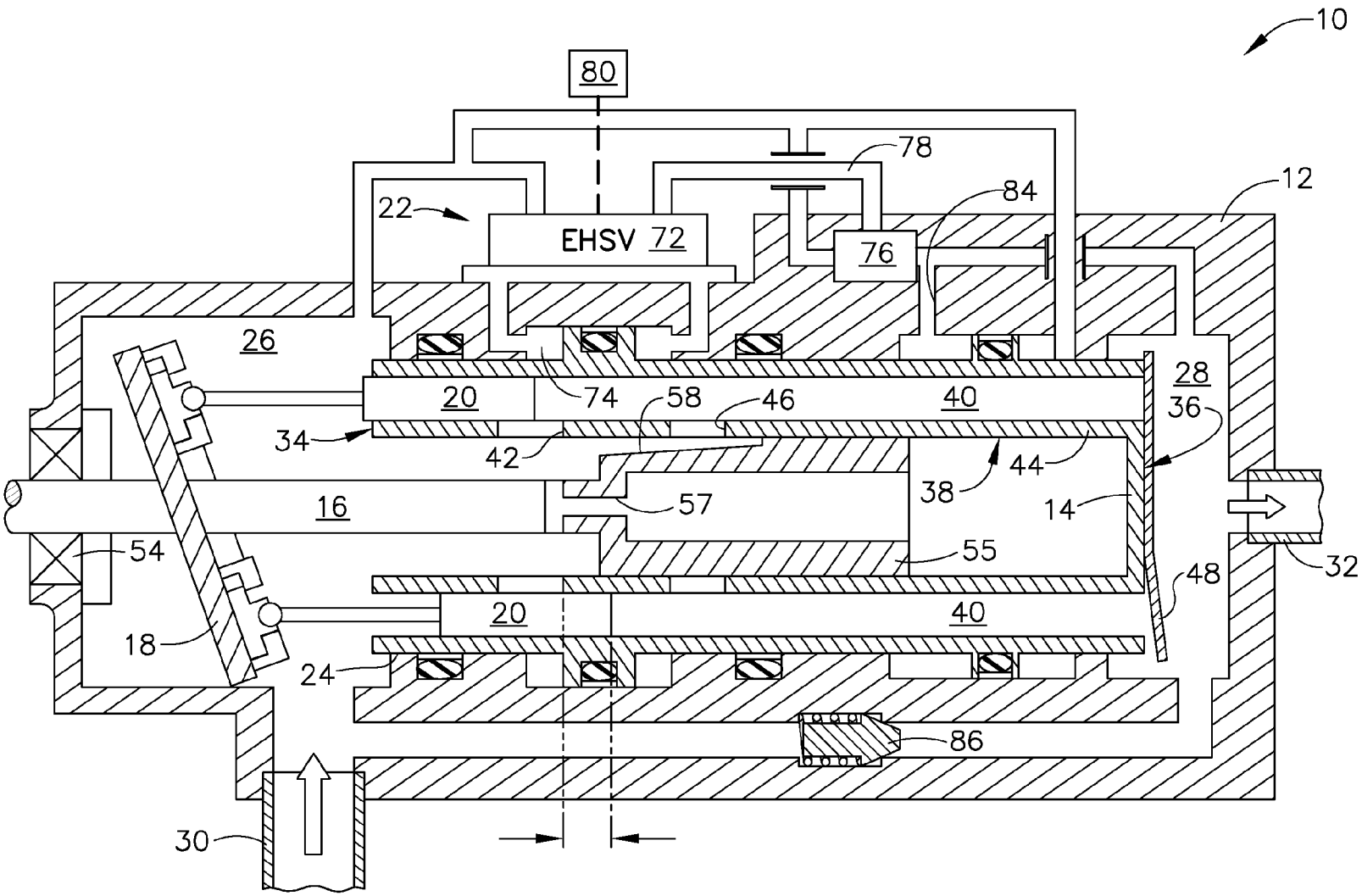
FIG. 2 is another view of the pump of FIG. 1.
Figure 3:
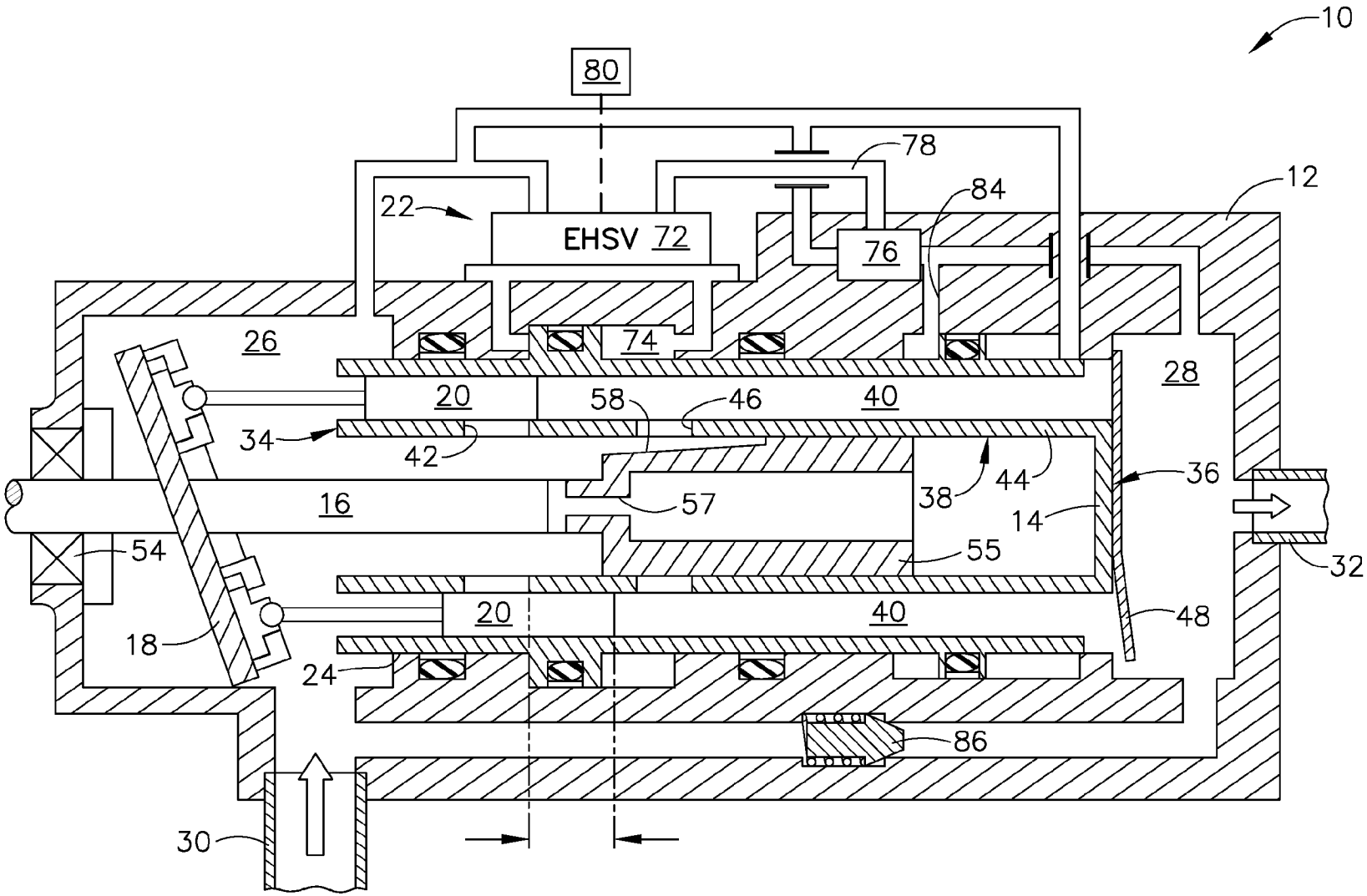
FIG. 3 is another view of the pump of FIG. 1.

Discharge flow is varied by altering the percentage of piston stroke delivering fluid to the discharge chamber 28 versus bypass flow back to the inlet chamber 26. This is achieved by modulation of the axial position of the cylinder block 14. FIG. 1 illustrates a minimum flow position of the cylinder block 14, where the cylinder block 14 is shifted towards the discharge chamber 28. This position exposes the first feed passages 42 for the maximum amount of the piston stroke. FIG. 2 illustrates an intermediate flow position. Relative to FIG. 1, the cylinder block 14 is shifted towards the inlet chamber 26. This causes the first feed passages 42 to be cut off sooner in the piston stroke. FIG. 3 illustrates a maximum flow position. In this position, the cylinder block 14 is shifted as far towards the inlet chamber 26 as possible. In this position there is no bypass flow through the first feed passages 42.

The pump may also include a balance piston 82. In operation, discharge pressure is ported to the balance piston 82 through a line 84. This pressure tends to drive the cylinder block 14 towards the right, in opposition to the force applied by discharge pressure on the second end of the cylinder block 14. The area of the balance piston 82 may be selected such that the net axial force on the cylinder block 14 is zero or very small, thereby reducing bearing loads. With the balance piston 82, the EHSV 72 need only have enough capacity to overcome seal friction and allows the EHSV 72 to be much smaller than it would have to be otherwise.

If desired, the pump 10 can include a pressure relief valve 86. If the discharge pressure exceeds the relief valve's set point, flow is bypassed to the inlet chamber 26.

The foregoing has described a variable flow pump. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A variable flow pump, comprising:

(a) a housing including an inlet chamber and an outlet chamber interconnected by a main bore;

(b) a non-rotating cylinder block with first and second ends disposed in the main bore, the cylinder block including:

(i) a central bore disposed in fluid communication with the inlet chamber;

(ii) a plurality of cylinder bores arrayed around the central bore;

(iii) a plurality of first feed passages interconnecting the inlet chamber and the cylinder bores, the first feed passages defining a bypass flowpath between the cylinder bores and the inlet chamber; and (iv) at least one check valve directly connected to the second end which permits fluid flow from the cylinder bores to the discharge chamber but prevents flow in the opposite direction;

(d) a plurality of pistons disposed in the bores;

(e) a shaft mechanically coupled to the pistons so as to cause the pistons to reciprocate through an axial pump stroke between predetermined fill and discharge positions, when the shaft is rotated; and (f) a mechanism coupled to the cylinder block which is adapted to selectively axially position the cylinder block within the housing, so as to vary the size of the bypass flowpath.

2. The pump of claim 1 wherein the mechanism coupled to the cylinder block comprises:

(a) a disk-like wobble plate carried by the shaft, wherein a working face of the wobble plate is disposed at a non-perpendicular angle to a rotational axis of the shaft;

(b) for each piston, a slipper which engages the working face; and (c) for each piston, a connecting rod coupled to the slipper and the piston.

3. The pump of claim 1 wherein the mechanism coupled to the cylinder block is a electrohydraulic servo valve.

4. The pump of claim 3 further including a pressure regulator coupled between the discharge chamber and the electrohydraulic servo valve and configured to supply regulated fluid pressure to electrohydraulic servo valve.

5. The pump of claim 1 wherein the check valve comprises a flat plate having a reed valve integrally formed therein.

6. A variable flow pump, comprising:

(a) a housing including an inlet chamber and an outlet chamber interconnected by a main bore;

(b) a non-rotating cylinder block with first and second ends disposed in the main bore, the cylinder block including:

(i) a central bore disposed in fluid communication with the inlet chamber;

(ii) a plurality of cylinder bores arrayed around the central bore;

(iii) a plurality of first feed passages interconnecting the inlet chamber and the cylinder bores, the first feed passages defining a bypass flowpath between the cylinder bores and the inlet chamber; and (iv) at least one check valve disposed at the second end which permits fluid flow from the cylinder bores to the discharge chamber but prevents flow in the opposite direction;

(d) a plurality of pistons disposed in the bores;

(e) a shaft mechanically coupled to the pistons so as to cause the pistons to reciprocate through an axial pump stroke between predetermined fill and discharge positions, when the shaft is rotated; and (f) a mechanism coupled to the cylinder block which is adapted to selectively axially position the cylinder block within the housing, so as to vary the size of the bypass flowpath wherein the mechanism coupled to the cylinder block is a electrohydraulic servo valve including a programmable controller operatively connected to the electrohydraulic servo valve.

7. A variable flow pump, comprising:

(a) a housing including an inlet chamber and an outlet chamber interconnected by a main bore;

(b) a non-rotating cylinder block with first and second ends disposed in the main bore, the cylinder block including:

(i) a central bore disposed in fluid communication with the inlet chamber;

(ii) a plurality of cylinder bores arrayed around the central bore;

(iii) a plurality of first feed passages interconnecting the inlet chamber and the cylinder bores, the first feed passages defining a bypass flowpath between the cylinder bores and the inlet chamber; and (iv) at least one check valve disposed at the second end which permits fluid flow from the cylinder bores to the discharge chamber but prevents flow in the opposite direction;

(d) a plurality of pistons disposed in the bores;

(e) a shaft mechanically coupled to the pistons so as to cause the pistons to reciprocate through an axial pump stroke between predetermined fill and discharge positions, when the shaft is rotated;

(f) a mechanism coupled to the cylinder block which is adapted to selectively axially position the cylinder block within the housing, so as to vary the size of the bypass flowpath; and a plurality of second feed passages interconnecting the inlet chamber and the cylinder bores, the second feed passages positioned axially downstream of the first feed passages.

8. A variable flow pump, comprising:

(a) a housing including an inlet chamber and an outlet chamber interconnected by a main bore;

(b) a non-rotating cylinder block with first and second ends disposed in the main bore, the cylinder block including:

(i) a central bore disposed in fluid communication with the inlet chamber;

(ii) a plurality of cylinder bores arrayed around the central bore;

(iii) a plurality of first feed passages interconnecting the inlet chamber and the cylinder bores, the first feed passages defining a bypass flowpath between the cylinder bores and the inlet chamber; and (iv) at least one check valve disposed at the second end which permits fluid flow from the cylinder bores to the discharge chamber but prevents flow in the opposite direction;

(d) a plurality of pistons disposed in the bores;

(e) a shaft mechanically coupled to the pistons so as to cause the pistons to reciprocate through an axial pump stroke between predetermined fill and discharge positions, when the shaft is rotated; and (f) a mechanism coupled to the cylinder block which is adapted to selectively axially position the cylinder block within the housing, so as to vary the size of the bypass flowpath;

wherein an end of the shaft terminates in a plug having a cylindrical outer surface which bears against the central bore of the cylinder block.

9. The pump of claim 8 wherein the plug defines a rotating inlet port which communicates with the inlet chamber and a subset of the cylinder bores through the second feed passages, and wherein the plug blocks flow through the remainder of the second feed passages.

10. A variable flow pump, comprising:

(a) a housing including an inlet chamber and an outlet chamber interconnected by a main bore;

(b) a non-rotating cylinder block with first and second ends disposed in the main bore, the cylinder block including:

(i) a central bore disposed in fluid communication with the inlet chamber;

(ii) a plurality of cylinder bores arrayed around the central bore;

(iii) a plurality of first feed passages interconnecting the inlet chamber and the cylinder bores, the first feed passages defining a bypass flowpath between the cylinder bores and the inlet chamber; and (iv) at least one check valve disposed at the second end which permits fluid flow from the cylinder bores to the discharge chamber but prevents flow in the opposite direction;

(d) a plurality of pistons disposed in the bores;

(e) a shaft mechanically coupled to the pistons so as to cause the pistons to reciprocate through an axial pump stroke between predetermined fill and discharge positions, when the shaft is rotated, and (f) a mechanism coupled to the cylinder block which is adapted to selectively axially position the cylinder block within the housing, so as to vary the size of the bypass flowpath;

wherein the cylinder block incorporates a balance piston and a line which communicates with the balance piston and the discharge chamber, the balance piston being configured to oppose force applied by discharge pressure on the second end of the cylinder block.

11. A method of operating a variable flow pump, comprising:

(a) receiving fluid into an inlet chamber of a housing of the pump, wherein the pump includes an inlet chamber and an outlet chamber interconnected by a main bore; and (b) using a piston which reciprocates through an axial pump stroke between predetermined fill and discharge positions:

(i) drawing fluid from the inlet chamber into a cylinder bore in a non-rotating cylinder block with first and second ends disposed in the main bore;

(ii) discharging fluid through the cylinder bore through a check valve directly connected to the non-rotating cylinder block ; and (iii) during discharge, selectively bypassing a portion of the fluid from the cylinder bore through a first feed passage into the inlet chamber, the proportion of bypass being controlled by modulating the axial position of the cylinder block within the housing.

12. The method of claim 11 wherein pistons are reciprocated by a wobble plate which is rotated by a shaft of the pump.

13. The method of claim 11 wherein the position of the cylinder block is modulated by an electrohydraulic servo valve.

14. The method of claim 13 further including supplying regulated fluid pressure to the electrohydraulic servo valve.

15. A method of operating a variable flow pump, comprising:

(a) receiving fluid into an inlet chamber of a housing of the pump, wherein the pump includes an inlet chamber and an outlet chamber interconnected by a main bore; and (b) using a piston which reciprocates through an axial pump stroke between predetermined fill and discharge positions:

(i) drawing fluid from the inlet chamber into a cylinder bore in a non-rotating cylinder block with first and second ends disposed in the main bore;

(ii) discharging fluid through the cylinder bore;

(iii) during discharge, selectively bypassing a portion of the fluid from the cylinder bore through a first feed passage into the inlet chamber, the proportion of bypass being controlled by modulating the axial position of the cylinder block within the housing and (c) opening a rotating feed port;

(d) using the piston, drawing fluid into the cylinder bore from the inlet chamber through a second feed passage which is positioned axially downstream of the first feed passages; and (e) closing the rotating feed port prior to discharging fluid from the cylinder bore.

16. A method of operating a variable flow pump, comprising:

(a) receiving fluid into an inlet chamber of a housing of the pump, wherein the pump includes an inlet chamber and an outlet chamber interconnected by a main bore; and (b) using a piston which reciprocates through an axial pump stroke between predetermined fill and discharge positions:

(i) drawing fluid from the inlet chamber into a cylinder bore in a non-rotating cylinder block with first and second ends disposed in the main bore;

(ii) discharging fluid through the cylinder bore;

(iii) during discharge, selectively bypassing a portion of the fluid from the cylinder bore through a first feed passage into the inlet chamber, the proportion of bypass being controlled by modulating the axial position of the cylinder block within the housing; and (c) porting fluid pressure to a balance piston of the cylinder block so as to oppose axial force applied by discharge pressure on the second end of the cylinder block.

* * * * *